US011799255B2

(12) United States Patent
Thijs et al.

(10) Patent No.: US 11,799,255 B2
(45) **Date of Patent: *Oct. 24, 2023**

(54) RECEPTACLE SOCKET ASSEMBLY FOR LIGHTING EQUIPMENT

(71) Applicant: Schreder S.A., Brussels (BE)

(72) Inventors: Marcel Thijs, Hoeselt (BE); Laurent Etorre, Schaerbeek (BE)

(73) Assignee: Schreder S.A., Brussels (BE)

( * ) Notice: Subject to any disclaimer, the term of this patent is extended or adjusted under 35 U.S.C. 154(b) by 0 days.

This patent is subject to a terminal disclaimer.

(21) Appl. No.: 17/971,911

(22) Filed: Oct. 24, 2022

(65) Prior Publication Data

US 2023/0041929 A1 Feb. 9, 2023

Related U.S. Application Data

(63) Continuation of application No. 17/289,034, filed as application No. PCT/EP2019/081006 on Nov. 12, 2019, now Pat. No. 11,482,821.

(30) Foreign Application Priority Data

Nov. 12, 2018 (NL) ..... 2021976

(51) Int. Cl.
*H01R 33/74* (2006.01)
*F21V 23/06* (2006.01)
(Continued)

(52) U.S. Cl.
CPC ..... *H01R 33/74* (2013.01); *F21V 23/06* (2013.01); *H01R 13/113* (2013.01); *H01R 13/506* (2013.01); *H01R 24/38* (2013.01)

(58) Field of Classification Search
CPC .... H01R 33/74; H01R 13/113; H01R 13/506; H01R 24/38; F21V 23/06
See application file for complete search history.

(56) References Cited

U.S. PATENT DOCUMENTS 5,685,067 A * 11/1997 Fudoo ..... H01R 4/185 29/749
7,291,046 B2 * 11/2007 Russelburg ..... H01R 43/16 439/857

(Continued)

FOREIGN PATENT DOCUMENTS

CN 106450920 B * 4/2019 ..... H01R 13/02
JP S61 99389 6/1986
WO WO 2011/138618 11/2011

OTHER PUBLICATIONS

International Search Report and Written Opinion dated Feb. 11, 2020 for International Application No. PCT/EP2019/081006, 10 pages.

*Primary Examiner* — Tho D Ta
(74) *Attorney, Agent, or Firm* — McDonnell Boehnen Hulbert & Berghoff LLP

(57) ABSTRACT

A receptacle socket assembly for lighting equipment comprising: a receptacle having a front side for receiving contacts of a control module, said receptacle housing a plurality of receptacle contacts, each receptacle contact being provided, at a front end, with a front contact portion for being electrically connected with a contact of a control module, and, at a rear end, with a rear contact portion; a wire connector having a front side and a rear side, said wire connector housing a plurality of connector contacts, each connector contact being provided, at a rear end, with a wire receiving contact for receiving and fixing a wire end and, at a front end, with a front contact portion; wherein the rear side of the receptacle and the front side of the wire connector are configured such that the wire connector is removably pluggable in the rear side of the receptacle.

16 Claims, 11 Drawing Sheets

(51) Int. Cl.

| | |
|---|---|
| ***H01R 13/11*** | (2006.01) |
| ***H01R 13/506*** | (2006.01) |
| ***H01R 24/38*** | (2011.01) |

(56) References Cited

U.S. PATENT DOCUMENTS

| | | | | |
|---|---|---|---|---|
| 8,033,874 | B2 * | 10/2011 | Chen | H01R 13/11 439/746 |
| 8,038,481 | B1 | 10/2011 | Creighton | |
| 8,398,435 | B2 * | 3/2013 | Aurongzeb | H01R 33/9456 439/607.41 |
| 9,077,112 | B2 | 7/2015 | Mitchell | |
| 9,638,405 | B2 | 5/2017 | Hobson | |
| 10,330,301 | B1 | 6/2019 | Howard | |
| 2012/0282815 | A1 | 11/2012 | Aurongzeb et al. | |

* cited by examiner

RECEPTACLE SOCKET ASSEMBLY FOR LIGHTING EQUIPMENT

CROSS REFERENCE TO RELATED APPLICATIONS

The present application is a continuation of, and claims priority to, U.S. application Ser. No. 17/289,034, filed Apr. 27, 2021, which is a national stage entry of, and claims priority to, PCT/EP2019/081006, filed on Nov. 12, 2019, which claims priority to European Patent Application NL 2021976, filed in the Netherlands Patent Office on Nov. 12, 2018, all three of which are hereby incorporated in their entirety herein by reference.

FIELD OF INVENTION

The field of the invention relates to receptacle socket assemblies for lighting equipment, wherein the receptacle socket assembly comprises a receptacle for receiving contacts of a control module.

BACKGROUND

Lighting equipment for roadways, parking lots and other outdoor areas typically use plug twist-lock control modules containing different control blocks and/or sensors, e.g. a light sensor for sensing the light level of ambient light to automatically control the light sources of the lighting equipment. For uniformity throughout the lighting industry, electrical receptacles for receiving such control modules are mostly made according to specific standards such as standards approved by American National Standards Institute, Inc. (ANSI). Such receptacles are typically mounted on the top of a housing or in an opening in the housing of the lighting equipment and are electrically connected to various components of the lighting equipment. The receptacle has a connection interface located on an external side of the housing, so that an external control module can be plugged into the receptacle to provide control for the lighting equipment.

A control module typically comprises three standard prongs or plug contacts which are inserted into corresponding apertures in the receptacle. After the prongs are completely inserted, the control module is rotated to lock it in place. The control module may comprise further contacts in the form of conductive springs for cooperating with receptacle contacts in the form of conductive plates. Preferably, the receptacle and the control module fulfil the requirements of the ANSI C136.41-2013 standard or of the ANSI C136.10-2017 standard or of the Zhaga Interface Specification Standard (Book 18, Edition 1.0, July 2018, see https://www.zhagastandard.org/data/downloadables/1/0/8/1/book_18.pdf).

SUMMARY

The object of embodiments of the invention is to provide a receptacle socket assembly for lighting equipment which can be more easily connected to components of the lighting equipment.

According to an aspect of the invention there is provided a receptacle socket assembly for lighting equipment. The receptacle socket assembly comprises a receptacle and a wire connector. The receptacle has a front side and a rear side. The front side is configured for receiving contacts of a pluggable control module for controlling the lighting equipment. The receptacle houses a plurality of receptacle contacts. Each receptacle contact is provided, at a front end, with a front contact portion configured for being electrically connected with a contact of a pluggable control module, and, at a rear end, with a rear contact portion. The wire connector has a front side and a rear side. The wire connector houses a plurality of connector contacts. Each connector contact is provided, at a rear end, with a wire receiving contact portion configured for receiving and fixing a wire end of a wire of the lighting equipment and, at a front end, with a front contact portion. The rear side of the receptacle and the front side of the wire connector are configured such that the wire connector is removably pluggable in the rear side of the receptacle and such that, in a plugged-in state, the front contact portions of the plurality of connector contacts are electrically connected to the rear contact portions of the plurality of receptacle contacts.

By providing a receptacle socket assembly which comprises on the one hand a receptacle which can be fixed to a housing of the lighting equipment, and on the other hand a wire connector, the connections can be made more easily. Indeed, the receptacle may be fixed in the housing and the wires to be connected may be fixed in the wire connector. To realise the connections with the control module, an operator can simply plug the wire connector in the receptacle which was pre-arranged in the housing.

According to an exemplary embodiment, the plurality of receptacle contacts comprises a plurality of first receptacle contacts and optionally one or more second receptacle contacts.

In an exemplary embodiment, seen in a radial direction around a central axis of the receptacle, the plurality of first receptacle contacts are positioned further away from the central axis than the one or more second receptacle contacts.

In a first variant, the one or more second receptacle contacts may be used for carrying one or more power signals for feeding components of the external control module, and the plurality of first receptacle contacts may be used for carrying data or control signals, typically low-current, low-voltage signals. Optionally, one of the plurality of first receptacle contacts and/or one of the one or more second receptacle contacts may be used for carrying both a power signal and a data or control signal.

In another variant, no second receptacle contacts are provided, and the plurality of first receptacle contacts comprises both one or more contacts for carrying a power signal as well as one or more contacts for carrying a data or control signal, wherein optionally one or more contacts may be used for carrying both power and data/control signals. In such an embodiment, typically, at least three first receptacle contacts are provided of which two carry power signals and one a data or control signal. In yet another variant without second receptacle contacts, the plurality of first receptacle contacts comprises only receptacle contacts for carrying power supply signals, e.g. two DC terminal contacts, of which one may be a ground terminal.

In a further variant, the one or more second receptacle contacts may be used for carrying one or more data or control signals, and the plurality of first receptacle contacts may be used for carrying power signals. The one or more second receptacle contacts may then be e.g. a central pin terminal surrounded by a cylindrical contact terminal (e g an RCA connector).

The skilled person understands that other combinations are possible, and that one or more receptacle contacts may be used for carrying both a power signal and a control/data signal and/or that control messages may be included in a power signal.

According to an exemplary embodiment, the plurality of receptacle contacts comprises a first plurality of receptacle contacts and a second plurality of receptacle contacts, wherein seen in a radial direction around a central axis of the receptacle, the first plurality of receptacle contacts are positioned further away from the central axis than the second plurality of receptacle contacts. The second plurality of receptacle contacts may be used for carrying power signals for feeding the components of the control module. The first plurality of receptacle contacts may be used for carrying data or control signals, typically low-current, low-voltage signals. The skilled person understands that other combinations are possible, and that one or more receptacle contacts may be used for carrying both power signals and control/data signals and/or that control messages may be included in a power signal. In another possible embodiment, the first plurality of receptacle contacts may be used for carrying power signals for feeding the components of the control module, and the second plurality of receptacle contacts may be used for carrying data or control signals, typically low-current, low-voltage signals.

Preferably, the first plurality of receptacle contacts extends substantially along a first cylindrical surface around the central axis, and the second plurality of receptacle contacts extends substantially along a second cylindrical surface around the central axis.

Preferably, the front contact portions of the first plurality of receptacle contacts extend flush with the front side of the receptacle. More preferably, the front contact portions of the plurality of receptacle contacts fulfil the requirements of the ANSI C136.41-2013 standard or the ANSI C136.10-2017 standard.

In another exemplary embodiment, the front contact portions of the plurality of first receptacle contacts are accessible via apertures in the front side of the receptacle and extend near the front side of the receptacle. For example, the front contact portions of the plurality of receptacle contacts fulfil the requirements of the Zhaga standard mentioned above.

According to an exemplary embodiment, the plurality of connector contacts comprises a plurality of first connector contacts and one or more second connector contacts, wherein, in the plugged-in state, seen in a radial direction around a central axis of the receptacle, the plurality of first connector contacts is positioned further away from the central axis than the one or more second connector contacts. Preferably, the plurality of first connector contacts extends substantially along a first cylindrical surface around the central axis, and the one or more second connector contacts extend substantially along a second cylindrical surface around the central axis.

According to an exemplary embodiment, the plurality of connector contacts comprises a first plurality of connector contacts and a second plurality of connector contacts, wherein, in the plugged-in state, seen in a radial direction around a central axis of the receptacle, the first plurality of connector contacts are positioned further away from the central axis than the second plurality of connector contacts. In that manner the connector contacts may be arranged substantially in line with the corresponding receptacle contacts, resulting in a compact assembly which is easy to connect.

Preferably, the first plurality of connector contacts extends substantially along a first cylindrical surface around the central axis, and the second plurality of connector contacts extends substantially along a second cylindrical surface around the central axis.

According to another exemplary embodiment, the plurality of receptacle contacts comprises a first plurality of receptacle contacts and a second central receptacle contact, wherein the first plurality of receptacle contacts, preferably at least three receptacle contacts, are positioned around the second central receptacle contact. The second receptacle contact may be used for carrying data or control signals, typically low-current, low-voltage signals. The first plurality of receptacle contacts may be used for carrying power signals for feeding the components of the control module. The plurality of connector contacts may then comprise a first plurality of connector contacts and a second central connector contact, wherein, the first plurality of connector contacts surround the second connector contact. In that manner the connector contacts may be arranged substantially in line with the corresponding receptacle contacts, resulting in a compact assembly which is easy to connect.

According to an exemplary embodiment, a receptacle contact of said plurality of receptacle contacts is provided at its rear end with a first rear contact portion and with a second rear contact portion. The first and the second rear contact portion are located at a distance of each other, and are both connected with the same front contact portion of the receptacle contact. The plurality of connector contacts comprises a first connector contact having a front contact portion in contact with the first rear contact portion and a second connector contact having a front contact portion in contact with the second rear contact portion. In that manner a receptacle contact is "duplicated" or "split" so that it can be connected to two connector contacts. In that manner, two wires can be easily connected to the same receptacle contact. Embodiments of the invention may have one or more "duplicated" or "split" receptacle contacts. In a possible embodiment, the first and the second rear contact portion of the receptacle contact extend substantially parallel to each other in an axial direction of the receptacle.

According to an exemplary embodiment, a receptacle contact of the first plurality of receptacle contacts is provided at its rear end with a first rear contact portion and with a second rear contact portion; and said first plurality of connector contacts comprises a first connector contact having a front contact portion in contact with the first rear contact portion and a second connector contact having a front contact portion in contact with the second rear contact portion; and a receptacle contact of the second plurality of receptacle contacts is provided at its rear end with a first rear contact portion and with a second rear contact portion at a distance of said first rear contact portion; and said second plurality of connector contacts comprises a first connector contact having a front contact portion in contact with the first rear contact portion and a second connector contact having a front contact portion in contact with the second rear contact portion. In other words, both a receptacle contact of the first plurality and a receptacle contact of the second plurality may be "duplicated" or "split".

According to an exemplary embodiment, the wire connector is provided with a plurality of ducts for receiving the plurality of connector contacts, said plurality of ducts protruding outwardly at the front side of the wire connector, and the receptacle is provide at its rear side with a plurality of channels extending in the direction of the front side and dimensioned for snugly receiving said plurality of ducts. By providing such ducts and channels, the wire connector can be easily plugged in the receptacle. Preferably, the position of the ducts and channels is such that the ducts of the wire connector can only be inserted in a single position in the receptacle, so that an operator cannot make mistakes when plugging the wire connector in the receptacle.

Preferably, the rear contact portions of the plurality of receptacle contacts are positioned in the plurality of channels, and are configured such that they can protrude in the plurality of ducts to contact the front contact portions of the plurality of connector contacts, in the plugged-in state of the wire connector. To that end, the ducts may be provided at their front end with apertures dimensioned to allow the rear contact portions of the plurality of receptacle contacts, e.g. axially oriented contact pads, to extend through the apertures into the ducts, in order to contact the front contact portions of the plurality of connector contacts. For example, a front end of each duct of the plurality of ducts may be provided with an aperture, e.g. a slit, configured for receiving a rear contact portion a receptacle contact.

Preferably, the plurality of ducts may comprise one or more first ducts protruding outwardly at the front side of the wire connector over a first length which is different from a second length over which one or more second ducts protrude outwardly at the front side. In that way the length of each duct may be adapted to the length and positon of the corresponding receptacle contact. In an exemplary embodiment, one duct of the plurality of ducts protrudes more outwardly at the front side than the other ducts of the plurality of ducts. In that manner the duct which protrudes more outwardly can be used as a guide when inserting the wire connector in the receptacle. Indeed, this duct will be inserted first, and the other ducts follow, making the alignment and insertion of the wire connector easier.

In an exemplary embodiment, one or more ducts of the plurality of ducts protrude outwardly in a rearward direction at the rear side of the wire connector, wherein the length over which the one or more ducts protrude outwardly in the rearward direction may be different for different ducts.

Preferably, a length of the plurality of ducts is larger than or equal to a length of the plurality of connector contacts, resulting in a wire connector with good security properties.

The plurality of ducts may comprise a plurality of first ducts and optionally one or more second ducts.

In an exemplary embodiment, seen in a radial direction around the central axis of the receptacle, the plurality of first ducts are positioned further away from the central axis than the one or more second ducts. The plurality of first ducts may have a length, seen in an axial direction, which is different from a length of the one or more second ducts. In that manner, a length of the plurality of ducts may be suitably adjusted to the length of the receptacle contacts.

Preferably, the plurality of first ducts extends substantially along a first cylindrical surface around the central axis. When more than one second duct is present, the two or more second ducts may extend substantially along a second cylindrical surface around the central axis. However, it is also possible to have two second ducts in the form of a central duct for a central pin and a surrounding duct for a surrounding contact (e.g. such that an RCA connector is formed). Also, if only one second duct is provided, it may be arranged centrally. Alternatively, it may be arranged externally of the first cylindrical surface, further away of the central axis of the receptacle. If no second ducts are present, typically at least three first ducts are present.

Preferably, the plurality of ducts comprises a first plurality of ducts and a second plurality of ducts, wherein, in the plugged-in state, seen in a radial direction around the central axis of the receptacle, the first plurality of ducts are positioned further away from the central axis than the second plurality of ducts. In that manner the ducts may be aligned with the receptacle contacts. More preferably, the first plurality of ducts protrude outwardly at the front side of the wire connector over a first length which is larger than a second length over which the second plurality of ducts protrude outwardly at the front side.

Preferably, the second and/or the first plurality of ducts protrude outwardly in a rearward direction at the rear side of the wire connector, wherein the length over which the second and/or the first plurality of ducts protrude outwardly in the rearward direction may be different. In that manner, a length of the plurality of ducts may be suitably adjusted, whilst still allowing that ducts protrude over different lengths in the forward direction. For example, the second plurality of ducts may be protruding outwardly in a rearward direction at the rear side of the wire connector, whilst the first plurality of ducts may be not protruding outwardly in a rearward direction.

According to an exemplary embodiment, the receptacle is provided with first snap-fit part and the wire connector is provided with a second snap-fit part configured to cooperate with the first snap-fit part in a plugged-in state of the wire connector in the receptacle. In that manner the wire connector can be locked into place, in a tool-less manner, when plugged in the receptacle, whilst avoiding an accidental removal during operation.

According to an exemplary embodiment, the front contact portions of the plurality of receptacle contacts extend at or near the front side of the receptacle.

According to an exemplary embodiment, the front contact portion of a connector contact of the plurality of connector contacts comprises at least one flexible lip, spring-mounted and configured for contacting the rear contact portion of a receptacle contact of the plurality of receptacle contacts. By using at least one flexible lip, a secure contact can be provided. Typically at least two flexible lips will be provided, e.g. two flexible lips spring-mounted with respect to each other. The use of at least two flexible lips allows for an even more secure contact between the front contact portions of the connector contacts and the rear contact portions which may be e.g. axially extending contacts pads which extend in the ducts to be received between the flexible lips of the front contact portions.

According to an exemplary embodiment, the receptacle is provided at the rear side thereof with a screw-thread, and the receptacle socket assembly further comprises a nut configured to be screwed on the screw-thread of the receptacle. In that manner the receptacle can be easily fixed in an opening of a housing of a luminaire. Alternatively or additionally, the receptacle can be fixed to the luminaire housing by screws.

According to an exemplary embodiment, the receptacle comprises a substantially cylindrical front portion at the front side of the receptacle, and a substantially cylindrical rear portion at the rear side of the receptacle, wherein the diameter of the front portion is larger than the diameter of the rear portion. In that manner the rear portion may be inserted through an opening of a housing with a more or less corresponding diameter, whilst the front portion abuts against a wall portion around the opening.

Preferably, the substantially cylindrical rear portion is provided with a flat wall portion extending in an axial direction of the receptacle, and the wire connector has a substantially cylindrical outer wall which is provided with a corresponding flat wall portion intended to be aligned with the flat wall portion of the receptacle in the plugged-in state of the wire connector. Such flat wall portions allow aligning the wire connector with respect to the receptacle when having to plug the wire connector in the receptacle.

Preferably, the receptacle socket assembly may further comprise a gasket inserted between the nut and the front portion.

According to an exemplary embodiment, the wire receiving contact portion comprises a first portion for clamping a wire end and a second portion for clamping a cable sheath end. In that manner the fixation of the cable in the wire receiving contact portion can be very secure.

According to an exemplary embodiment, the receptacle comprises an RFID tag, preferably at the front side of the receptacle. The including of an RFID tag in a receptacle has been described in detail in PCT publication WO2017/133793 in the name of the applicant, which is included herein by reference.

According to an exemplary embodiment, the plurality of receptacle contacts comprises at least two receptacle contacts for carrying power signals and/or one or more receptacle contacts for carrying data or control signals and/or one or more receptacle contacts for carrying power signals and data or control signals. In a preferred embodiment, the plurality of receptacle contacts comprises at least three receptacle contacts for carrying power signals and/or at least two receptacle contacts for carrying data or control signals. In another exemplary embodiment, the plurality of receptacle contacts comprises one receptacle contact for carrying a power signal, one receptacle contact for carrying both a power and a data/control signal, and/or at least two receptacle contacts for carrying data or control signals.

It is noted that the at least two power signals may comprise DC and/or AC signals. For example, a DC power supply signal may be transferred through the receptacle, wherein there is provided a first DC terminal contact for a positive DC voltage and a second DC terminal contact for a ground connection (wherein optionally the ground connection may also be used as a ground terminal for a data or control signal). Such an embodiment may be conforming the Zhaga standard mentioned above. Alternatively or in addition, an AC power supply signal may be transferred through the receptacle, wherein there is provided a first, second and third AC terminal contact for a three-phase AC signal. Such an embodiment may be conform the NEMA standards mentioned above.

In a preferred embodiment, each receptacle contact is an integrally formed contact made of metal, i.e. the receptacle contact is formed as one integral metal body.

According to an exemplary embodiment, the wire connector and the receptacle are designed such that the wire connector can be plugged only in one position into the receptacle, in order to avoid misconnection. For example, the plurality of receptacle contacts and the plurality of connector contacts may be arranged in an asymmetric manner. In addition or alternatively, this may be ensured by the presence of a snap-fit mechanism as described above.

According to another aspect of the invention, there is provided a luminaire comprising a housing with an opening and a receptacle socket assembly according to any one of the previous embodiments, wherein the receptacle is arranged in the opening of the housing with its rear side facing an inner space of the housing, and wherein the wire connector is connected to components inside the housing and plugged in the receptacle.

According to yet another aspect of the invention, there is provided a wire connector for use in a receptacle socket assembly according to any one of the embodiments above. The wire connector may be provided with any one of the features described above.

According to yet another aspect of the invention, there is provided a receptacle for use in a receptacle socket assembly according to any one of the embodiments above. The receptacle may be provided with any one of the features described above.

The control module may comprise any one or more of the following: a sensor (e.g. a light sensor, a motion sensor, a passive infrared sensor, etc.), communication circuitry, control circuitry, protection circuitry (e.g. an SPD or a fuse), an actuator, etc. More generally the control module may comprise any component that needs to be powered, any component involved in the transmission and/or reception of signals, any component completing the circuitry inside the luminaire head, such as protection circuitry, etc.

It is further noted that the control module may be configured to receive a further control module. In other words, a stack of interconnected control modules may be arranged in the receptacle, wherein some functionalities may be included in a first control module and other functionalities in a second control module. In that manner, the system is given an extra degree of modularity.

Also, it is noted that it is possible to provide one or more functionalities in the receptacle socket itself, such as a sensor, communication circuitry, control circuitry, protection circuitry (e.g. an SPD or a fuse), an actuator, etc.

According to yet another aspect, the invention relates to a use of a receptacle according to any one of the previous embodiments, for transferring at least two power signals and optionally at least one data and/or control signal via the plurality of receptacle contacts between one or more components of an external control module and one or more components arranged in a housing of a luminaire. It is noted that at least two receptacle contacts of the plurality of receptacle contacts may be used for carrying power signals and that one or more receptacle contacts may be used for carrying data or control signals, wherein optionally one or more receptacle contacts are used for carrying both a power signal and a data or control signal.

It is noted that the at least two power signals may comprise DC and/or AC signals. For example, a DC power supply signal may be transferred through the receptacle, wherein there is provided a first DC terminal contact for a positive DC voltage and a second DC terminal contact for a ground connection (wherein optionally the ground connection may also be used as a ground terminal for a data or control signal). Such an embodiment may be conforming the Zhaga standard mentioned above. Alternatively or in addition, an AC power supply signal may be transferred through the receptacle, wherein there is provided a first, second and third AC terminal contact for a three-phase AC signal. Such an embodiment may be conform the NEMA standards mentioned above.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1:
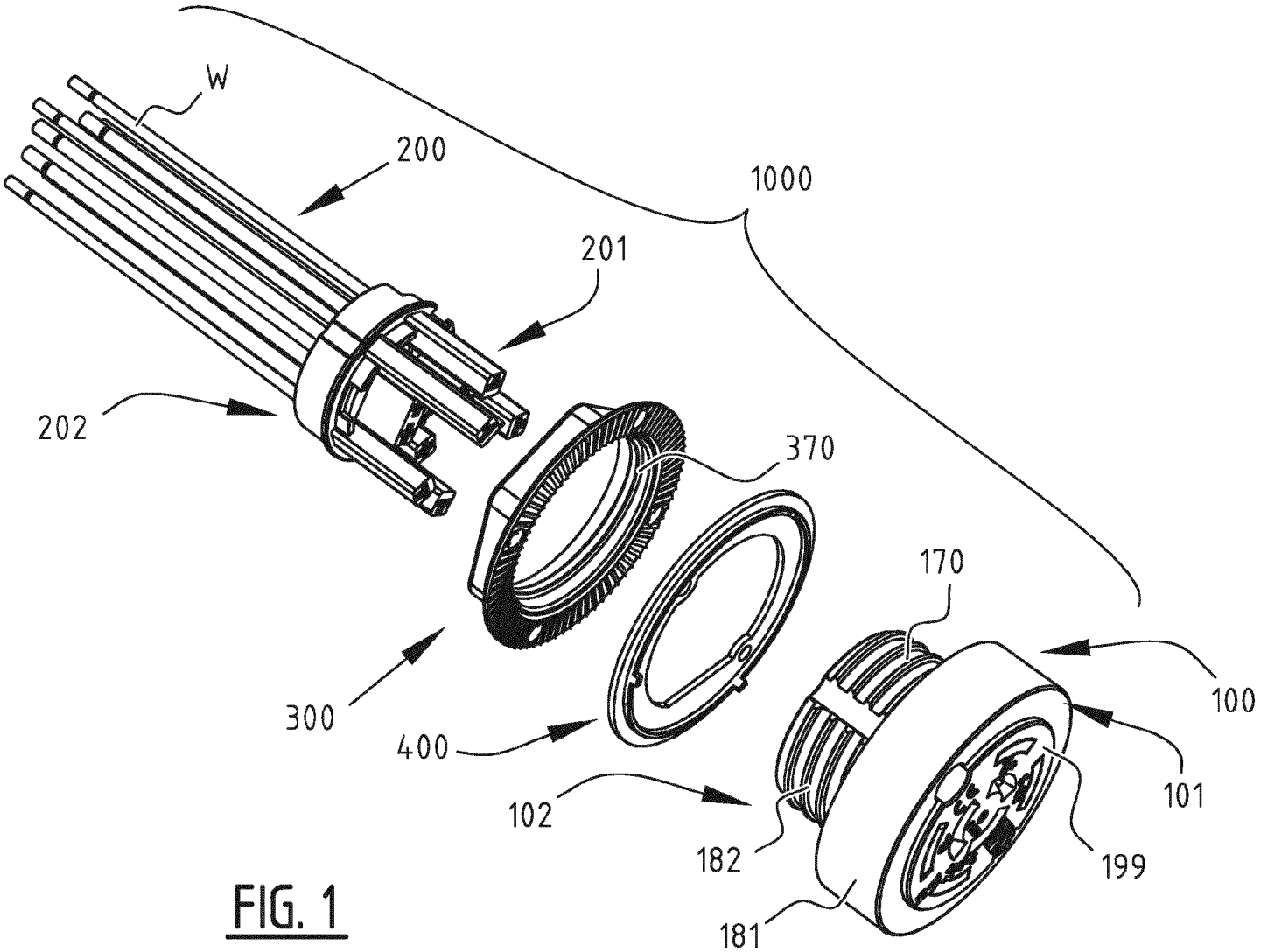
FIG. 1 is a schematic exploded view of an exemplary embodiment of a receptacle socket assembly.

FIG. 1 illustrates an exemplary embodiment of a receptacle socket assembly for lighting equipment, typically for an outdoor luminaire. The receptacle socket assembly 1000 comprises a receptacle 100, a wire connector 200, a nut 300 for fixing the receptacle 100 in an opening of a housing H, and a gasket 400 to be inserted between the receptacle 100 and the nut 300.

Figure 11:
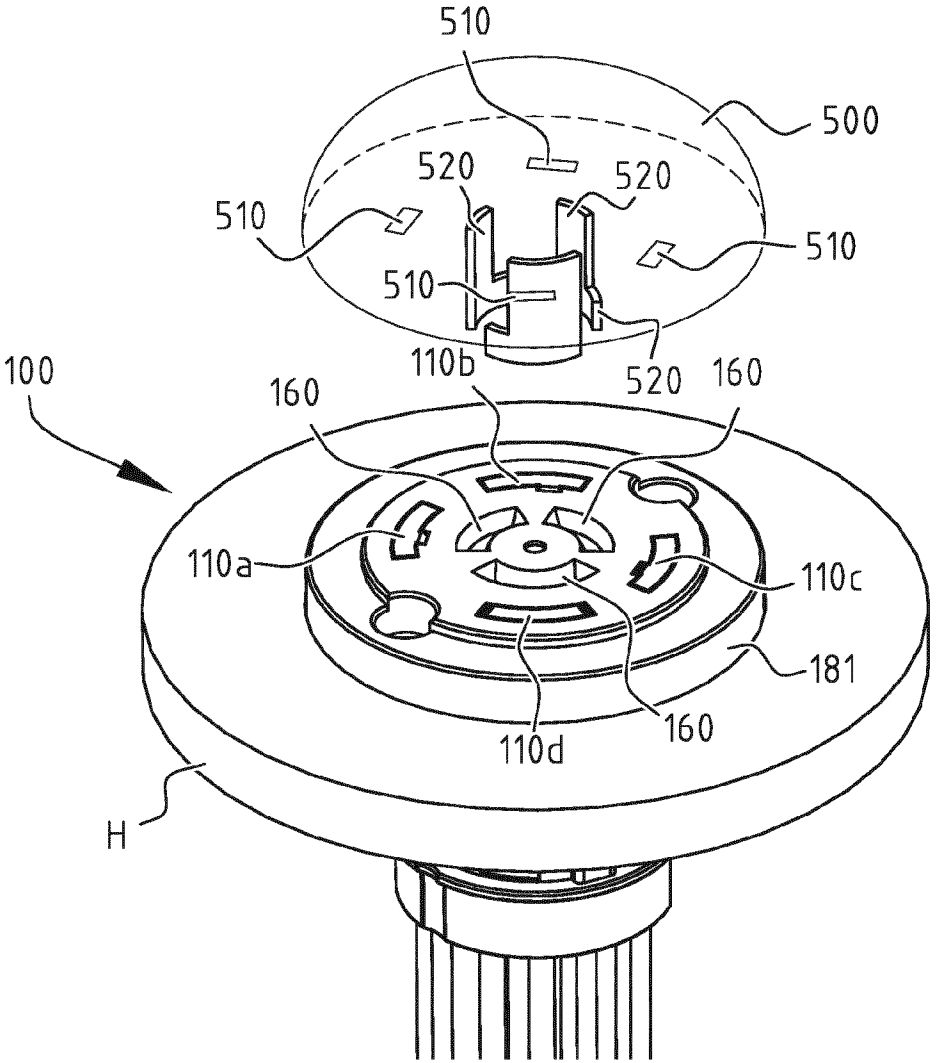
FIG. 11 is a schematic perspective view of an embodiment of a receptacle socket assembly mounted in a housing H and of a control module to be plugged in the receptacle of the receptacle socket assembly.

Lighting equipment for roadways, parking lots and other outdoor areas typically use plug twist-lock control modules 500 (see FIG. 11) containing different control blocks and/or sensors (not shown). A control module 500 may comprise e.g. a light sensor for sensing the light level of ambient light to automatically switch light fixtures on at dusk and off at dawn. For uniformity throughout the lighting industry, electrical receptacles 100 for receiving such control modules 500 are mostly made according to specific standards such as standards approved by American National Standards Institute, Inc. (ANSI). Such receptacles 100 are typically mounted on the top of a housing H (see FIG. 11) of the lighting equipment and are electrically connected to various components (not shown) of the lighting equipment through wires W. A control module 500 is plugged into a receptacle 100 to provide control for the lighting equipment.

A control module 500 typically comprises three standard prongs 520 (see FIG. 11, also called plug contacts or simply contacts) which are inserted into corresponding apertures 160 in the receptacle 100. After the prongs 520 are completely inserted, the control module 500 is rotated to lock it in place. When locked in place, the prongs 520 contact the receptacle contacts 120*a-c*, see also FIG. 4B which will be discussed in detail below. The control module 500 may comprise further contacts 510 in the form of conductive springs for cooperating with receptacle contacts 110*a-d* of receptacle 100 in the form of conductive plates, see also FIG. 4B which will be discussed in detail below. Preferably, the receptacle 100 and the control module 500 fulfil the requirements of the ANSI C136.41-2013 standard.

Figure 4B:
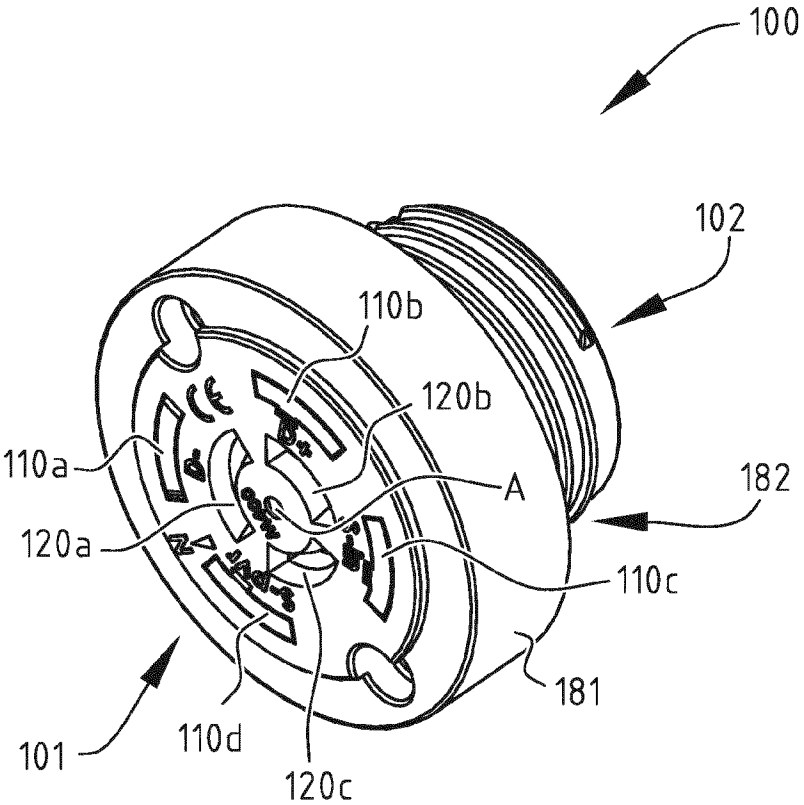
FIGS. 4A and 4B is a schematic perspective view of an exemplary embodiment of a receptacle of a receptacle socket assembly, seen from a rear side and from a front side, respectively.
Figure 4A:
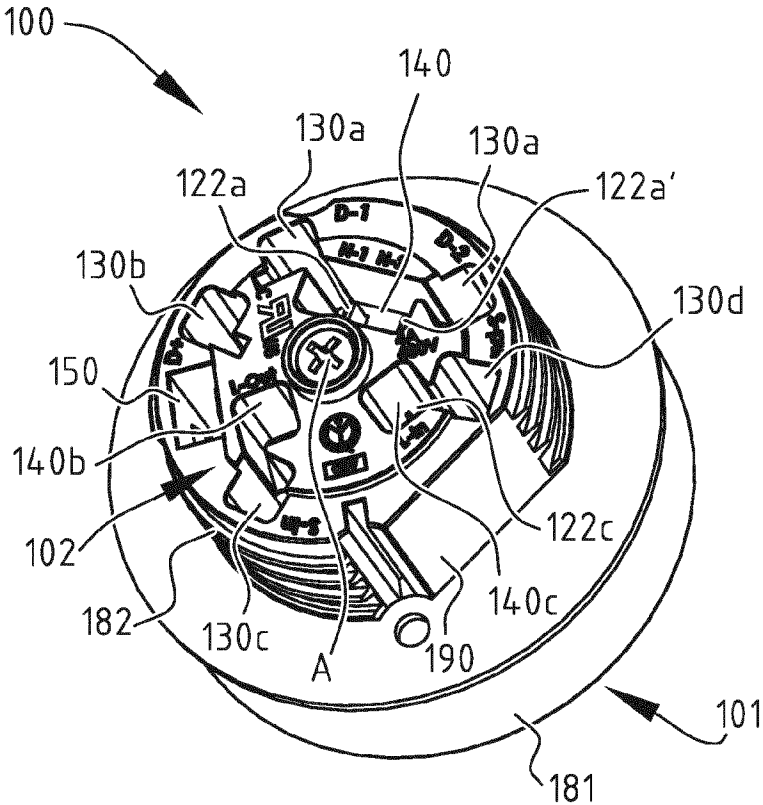
Figure 5B:
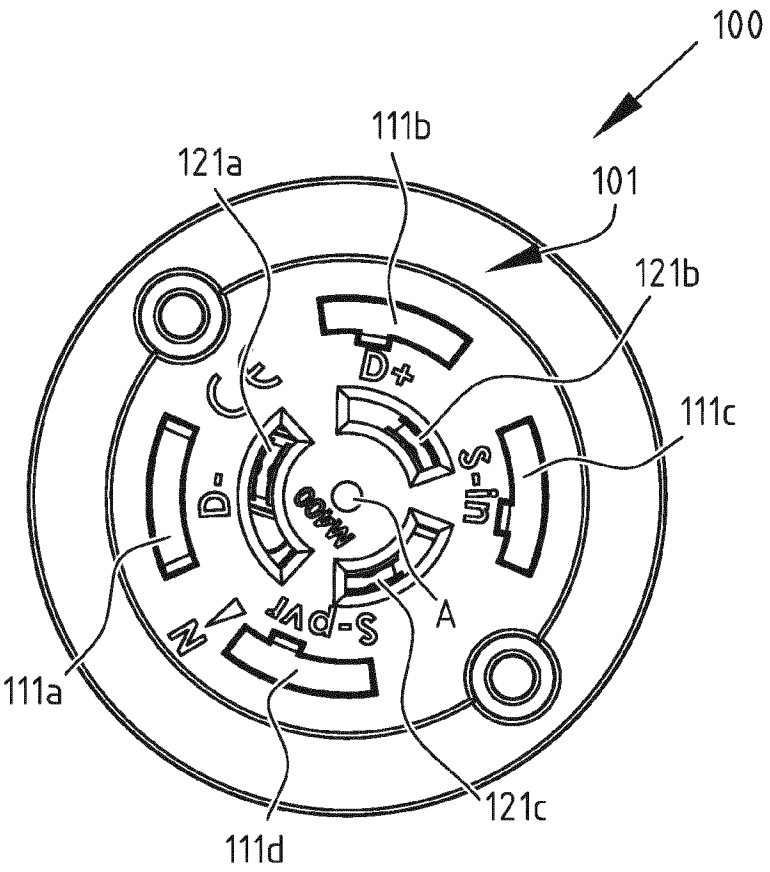
FIG. 5B is a schematic front view of the receptacle of FIG. 4A.

The receptacle 100 has a front side 101 and a rear side 102. The front side 101 is configured for receiving contacts of the pluggable control module (not shown). An RFID tag may be provided at or near the front side 101, as indicated with arrow 199 in FIG. 1. The receptacle 100 is shown in FIGS. 1, 4A-4B, 5A-5B, 6 and 10. As shown in FIGS. 4B and 5B, the receptacle 100 houses a plurality of receptacle contacts 110*a-d*, 120*a-c*. Each receptacle contact 110*a-d*, 120*a-c* is provided, at a front end, with a front contact portion 111*a-d*, 121*a-c* configured for being electrically connected with a contact of a control module, see FIG. 5B which shows the front side 101 of the receptacle 100. Each receptacle contact 110*a-d*, 120*a-c* is provided, at a rear end, with a rear contact portion 112*a-d*, 112*a*', 122*a-c*, 122*a*', see FIG. 5A.

The wire connector 200 has a front side 201 and a rear side 202. The wire connector 200 is shown in FIGS. 1, 2A-2C, 3A-3B and 10. As shown in FIG. 2C, the wire connector 200 houses a plurality of connector contacts 210*a-d*, 210*a*', 220*a-c*, 220*a*'. As shown in FIGS. 2C and 3B, each connector contact 210*a-d*, 210*a*', 220*a-c*, 220*a*' is provided, at a rear end, with a wire receiving contact portion 212*a-d*, 212*a*', 222*a-c*, 222*a*' configured for receiving and fixing a wire end of a wire W to be connected to the lighting equipment. As shown in FIGS. 2C and 3A, each connector contact 210*a-d*, 210*a*', 220*a-c*, 220*a*' is provided, at a front end, with a front contact portion 211*a-d*, 211*a*', 221*a-c*, 221*a*'.

Figure 10:
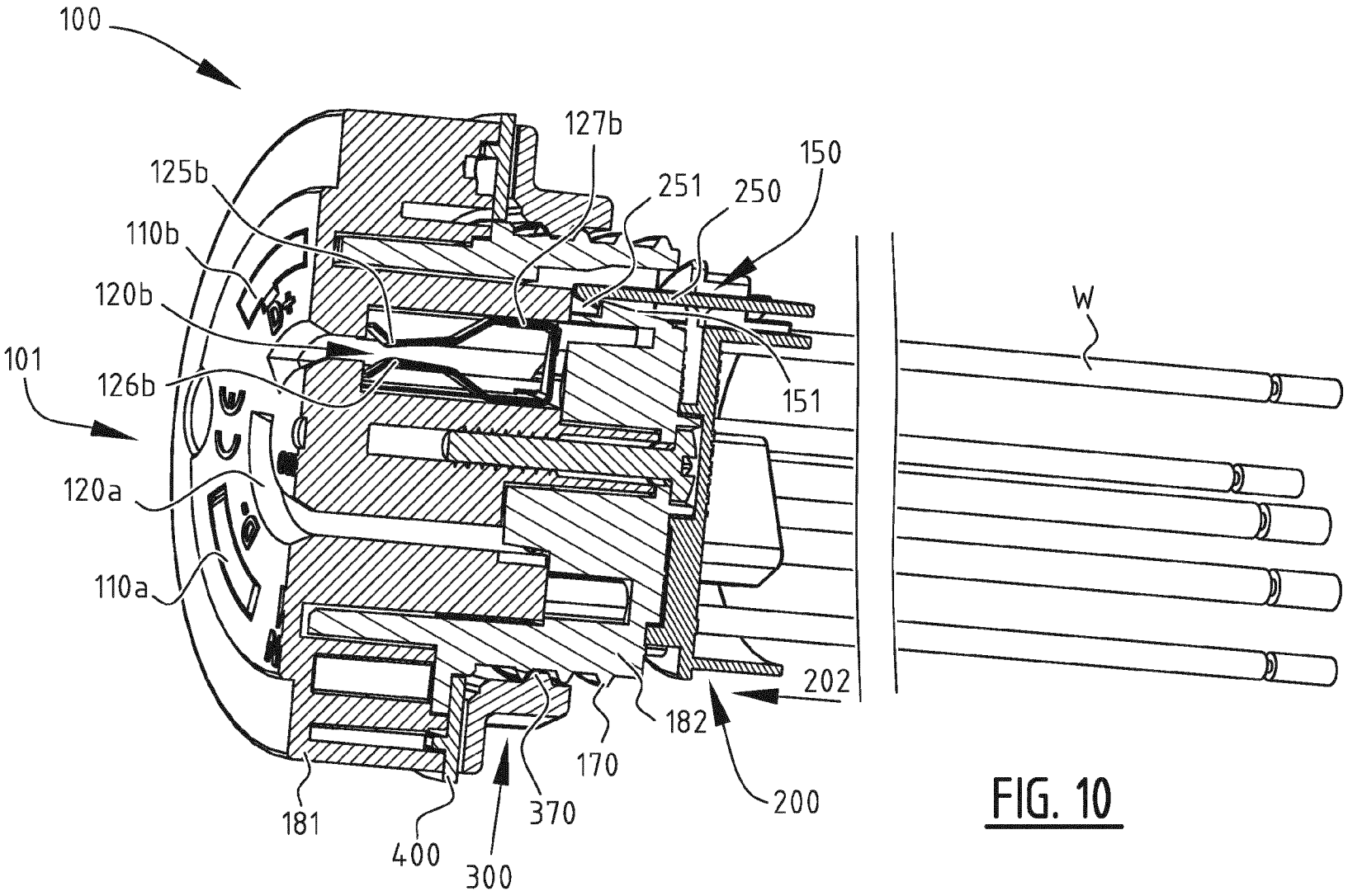
FIG. 10 is a partially cut perspective view of an embodiment of a wire connector plugged-in in a receptacle.

The rear side 102 of the receptacle 100 and the front side 201 of the wire connector 200 are configured such that the wire connector 200 is removably pluggable in the rear side 102 of the receptacle 100 and such that, in a plugged-in state, see FIG. 10, the front contact portions 211*a-d*, 211*a*', 221*a-c*, 221*a*' of the plurality of connector contacts 210*a-d*, 210*a*', 220*a-c*, 220*a*' are electrically connected to the rear contact portions 112*a-d*, 112*a*', 122*a-c*, 122*a*' of the plurality of receptacle contacts 110*a-d*, 110*a*', 120*a-c*, 120*a*'.

Preferably, the plurality of receptacle contacts 110*a-d*, 120*a-c* comprises at least two receptacle contacts for carrying power signals and/or one or more receptacle contacts for carrying data or control signals and/or one or more receptacle contacts for carrying power signals and data or control signals. In the illustrates embodiment receptacle contacts 110*a-d* may be for carrying data or control signals and receptacle contacts 120*a-c* may be for carrying power signals.

Figure 7B:
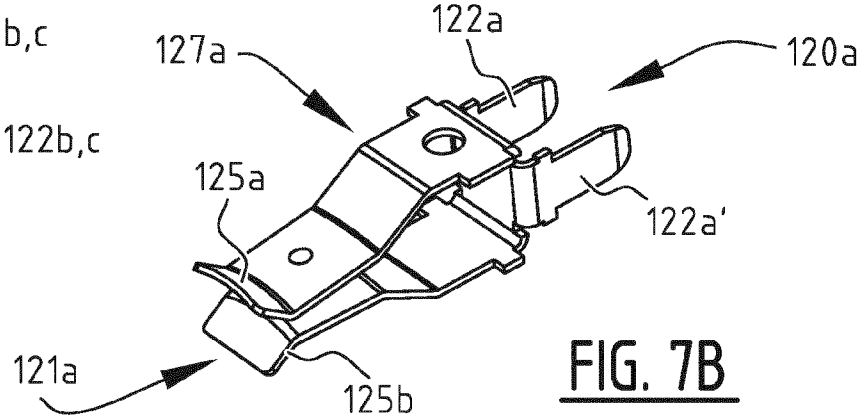
FIGS. 7A, 7B, 8A, 8B are schematic perspective views of embodiments of receptacle contacts for use in a receptacle.
Figure 7A:
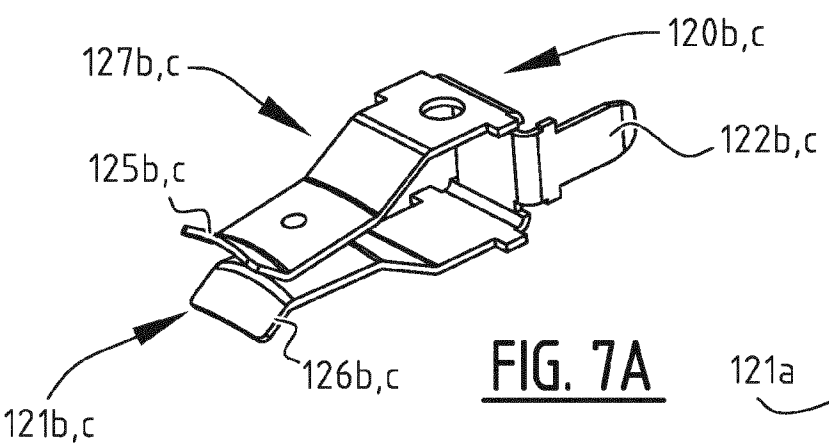
Figure 8B:
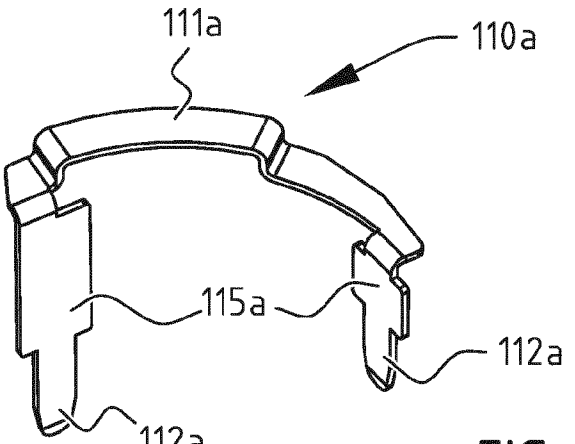
Figure 8A:
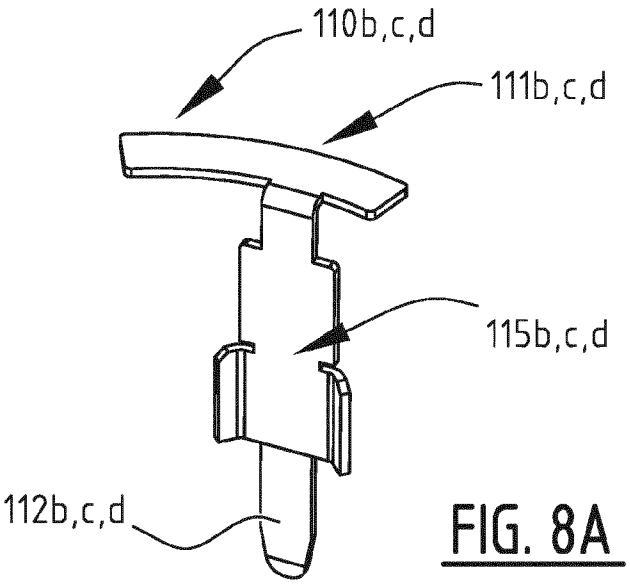

The plurality of receptacle contacts 110*a-d*, 120*a-c* comprises a first plurality of receptacle contacts 110*a-d* and a second plurality of receptacle contacts 120*a-c*. As is best visible in FIGS. 4A-4B and 5A-5B, seen in a radial direction around a central axis A of the receptacle 100, the first plurality of receptacle contacts 110*a-d* are positioned further away from the central axis than the second plurality of receptacle contacts 120*a-c*. The first plurality of receptacle contacts 110*a-d* extends in an axial direction, substantially along a first (virtual) cylindrical surface around the central axis A, and the second plurality of receptacle contacts 120*a-c* extends in an axial direction, substantially along a second (virtual) cylindrical surface around the central axis A, said second cylindrical surface having a smaller diameter than said first cylindrical surface. The front contact portions 111*a-d* of the first plurality of receptacle contacts 110*a-d* extend flush with the front side 101 of the receptacle 100. The first plurality of receptacle contacts 110*a-d* is shown in detail in FIGS. 8A and 8B. Each first receptacle contacts 110*a-d* has a front contact portion 111*a-d* in the form of a plate intended to extend flush with the front side 101 of the receptacle 100, a rear contact portion 112*a-d*, 112*a*' intended to extend substantially in the axial direction A of the receptacle, and a connection portion 115*a-d* connecting the front contact portion 111*a-d* with the rear contact portion 112*a-d*, 112*a*'. In the illustrated embodiment one front contact portion 110*a* is provided with two rear contact portions 112*a*, 112*a*'. The second plurality of receptacle contacts 120*a-c* is shown in detail in FIGS. 7A and 7B. Each first receptacle contact 120*a-c* has a front contact portion 121*a-c* with two flexible lips 125*a-c*, 126*a-c* for receiving a contact prong of a control module, a rear contact portion 122*a-c*, 122*a*' intended to extend substantially in the axial direction A of the receptacle 100, and a connection portion 127*a-c* connecting the front contact portion 121*a-c* with the rear contact portion 122*a-c*, 122*a*'. The front contact portions 111*a-d*, 121*a-c* of the plurality of receptacle contacts 110*a-d*, 120*a-c* extend at or near the front side 101 of the receptacle 100. In other words, the receptacle contact 110*a* has a split or duplicated rear contact portion comprising a first rear portion 112*a* and a second rear portion 112*a*'. Similarly, the receptacle contact 120*a* has a split or duplicated rear contact portion comprising a first rear portion 122*a* and a second rear portion 122*a'*

The plurality of connector contacts 210*a-d*, 210*a*', 220*a-c*, 220*a*' comprises a first plurality of connector contacts 210*a-d*, 210*a*' and a second plurality of connector contacts 220*a-c*, 220*a*'. As is best visible in FIGS. 3A-3B, seen in a radial direction around a central axis A of the receptacle 100 and the wire connector 200, the first plurality of connector contacts 210*a-d*, 210*a*' are positioned further away from the central axis A than the second plurality of connector contacts 220*a-c*, 220*a*'. The first plurality of connector contacts 210*a-d*, 210*a*' extends substantially along a first (virtual) cylindrical surface around the central axis A, and the second plurality of connector contacts 220*a-c*, 220*a*' extends substantially along a second (virtual) cylindrical surface around the central axis A, said second cylindrical surface having a smaller diameter than said first cylindrical surface. The plurality of connector contacts 210*a-d*, 210*a*', 220*a-c*, 220*a*' is shown in detail in FIG. 9A. Each connector contact 210*a-d*, 210*a*', 220*a-c*, 220*a*' has a front contact portion 211*a-d*, 211*a*', 221*a-c*, 221*a*', a wire receiving contact portion 212*a-d*, 212*a*', 222*a-c*, 222*a*' and a connection portion 217 connecting the front contact portion 211*a-d*, 211*a*', 221*a-c*, 221*a*' with the wire receiving contact portion 212*a-d*, 212*a*', 222*a-c*, 222*a*'. The front contact portion 211*a-d*, 211*a*', 221*a-c*, 221*a*' comprises at least two flexible lips 215, 216, spring-mounted with respect to each other, and configured for receiving the rear contact portion 112*a-d*, 112*a*', 122*a-c*, 122*a*' of a receptacle contact 110*a-d*, 120*a-c*. The front contact portion 211*a-d*, 211*a*', 221*a-c*, 221*a*' may comprise a first portion 218 for clamping a wire end and a second portion 219 for clamping a cable sheath end surrounding the wire.

Figure 9B:
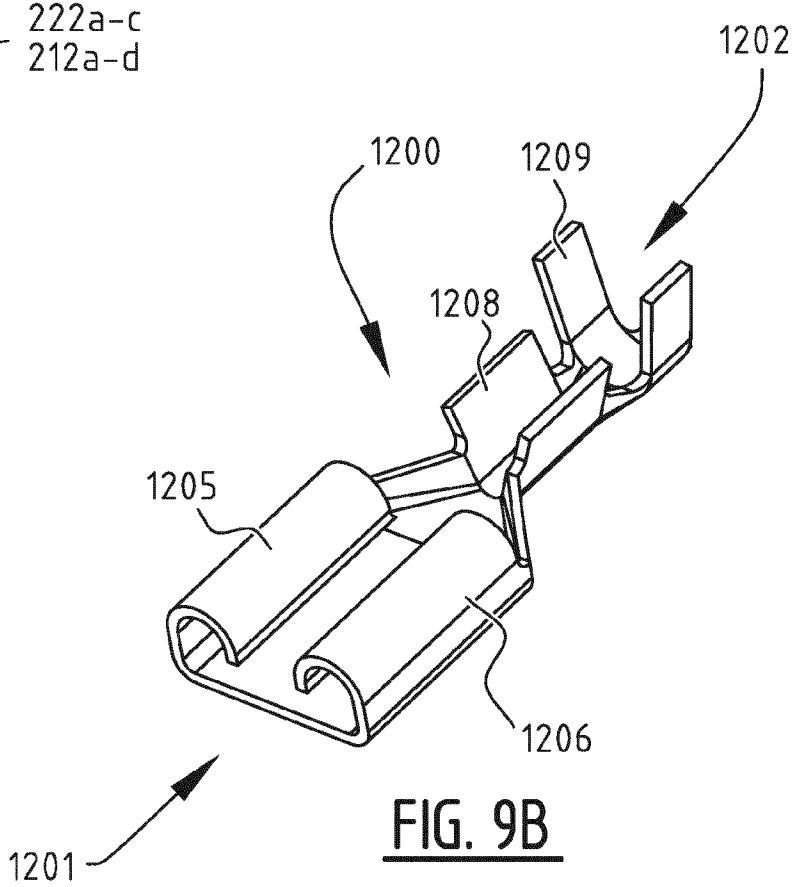
FIGS. 9A and 9B are schematic perspective views of embodiments of connector contacts for use in a wire connector.
Figure 9A:
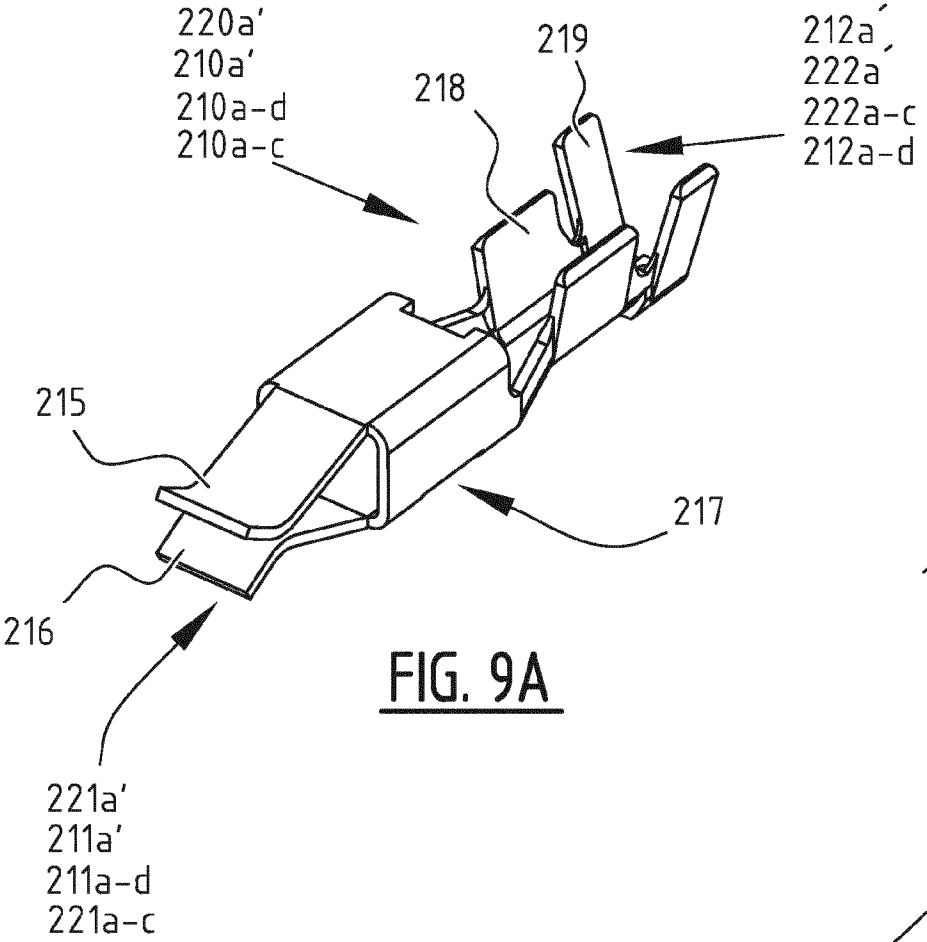

FIG. 9B illustrates another embodiment of a possible connector contact 1200. The connector contact 1200 has a front contact portion 1201, a wire receiving contact portion 1202 and a connection portion connecting the front contact portion 1201 with the wire receiving contact portion 1202. The front contact portion 1201 comprises two flexible lips 1205, 1206 configured for pressing against a rear contact portion 112*a-d*, 112*a*', 122*a-c*, 122*a*' of a receptacle contact 110*a-d*, 120*a-c*, when inserted in the front contact portion 1201. The wire receiving contact portion 1202 may comprise a first portion 1208 for clamping a wire end and a second portion 1209 for clamping a cable sheath end.

Figure 5A:
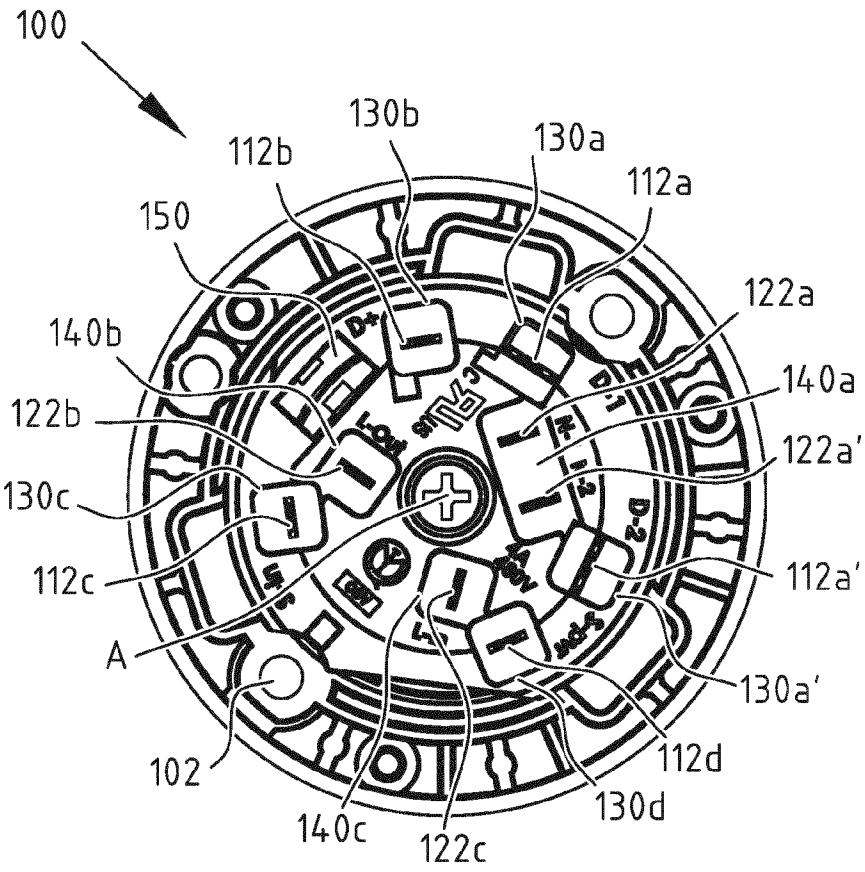
FIG. 5A is a schematic rear view of the receptacle of FIG. 4A.

As shown in FIGS. 2C and 5A, the connector contact 210*a* has a front contact portion 211*a* intended to be in contact with the rear contact portion 112*a* of the receptacle contact 110*a*, and the connector contact 210*a*' has a front contact portion 211*a*' intended to be in contact with the rear contact portion 112*a*' of a receptacle contact 110*a*'. The receptacle contact 120*a* is provided at its rear end with a first rear contact portion 122*a* and with a second rear contact portion 122*a*' at a distance of said first rear contact portion 122*a*. The connector contact 220*a* has a front contact portion 221*a* intended to be in contact with the first rear contact portion 122*a*, and the connector contact 220*a*' has a front contact portion 221*a*' intended to be in contact with the second rear contact portion 122*a*'. In other words, the wire connector 200 allows connecting two wires to receptacle contact 110*a*, and two wires to receptacle contact 120*a*.

Figures 2A, 2B:
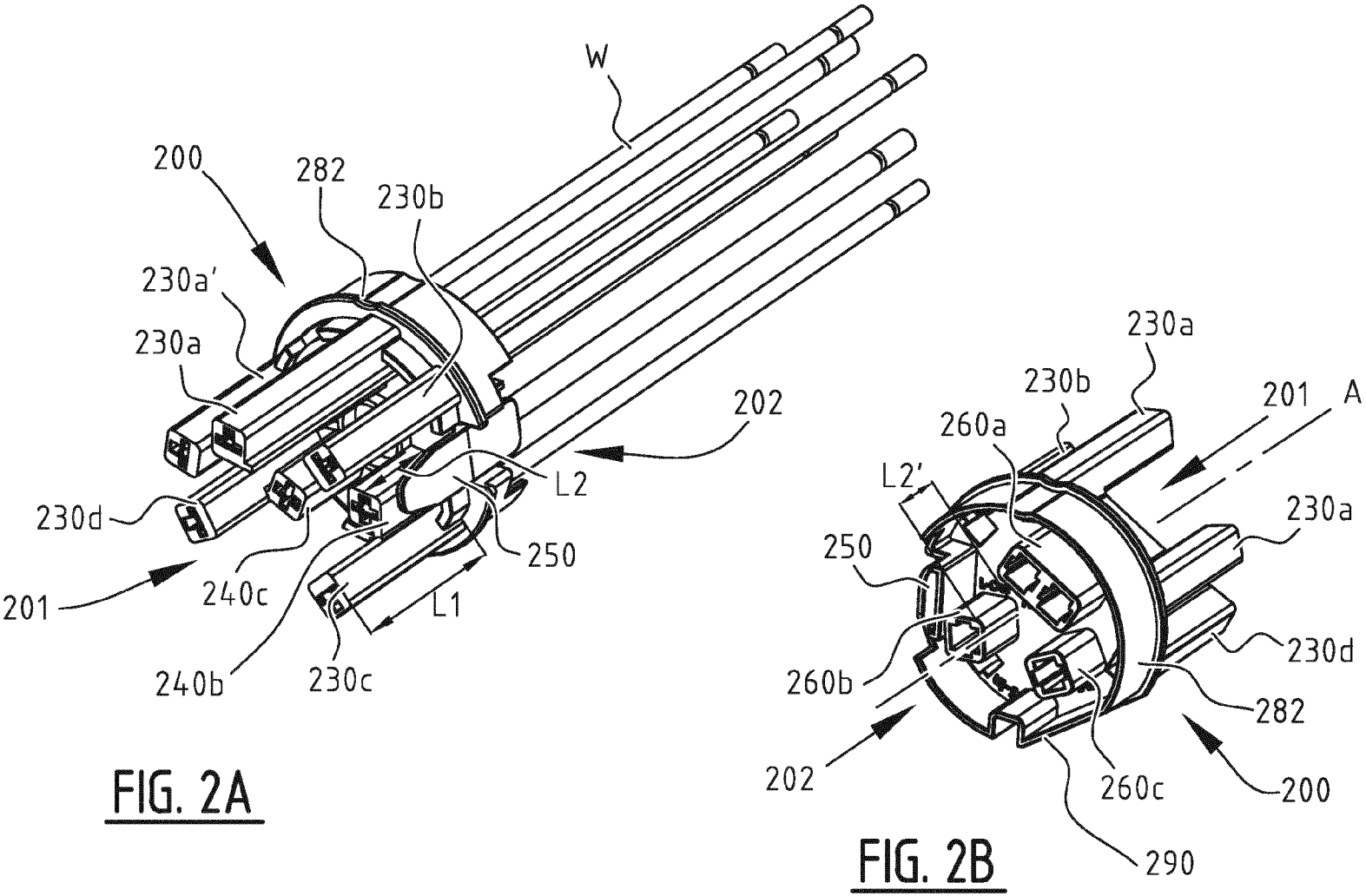
FIGS. 2A and 2B is a schematic perspective view of an exemplary embodiment of a wire connector of a receptacle socket assembly, seen from a front side and from a rear side, respectively.
Figure 2C:
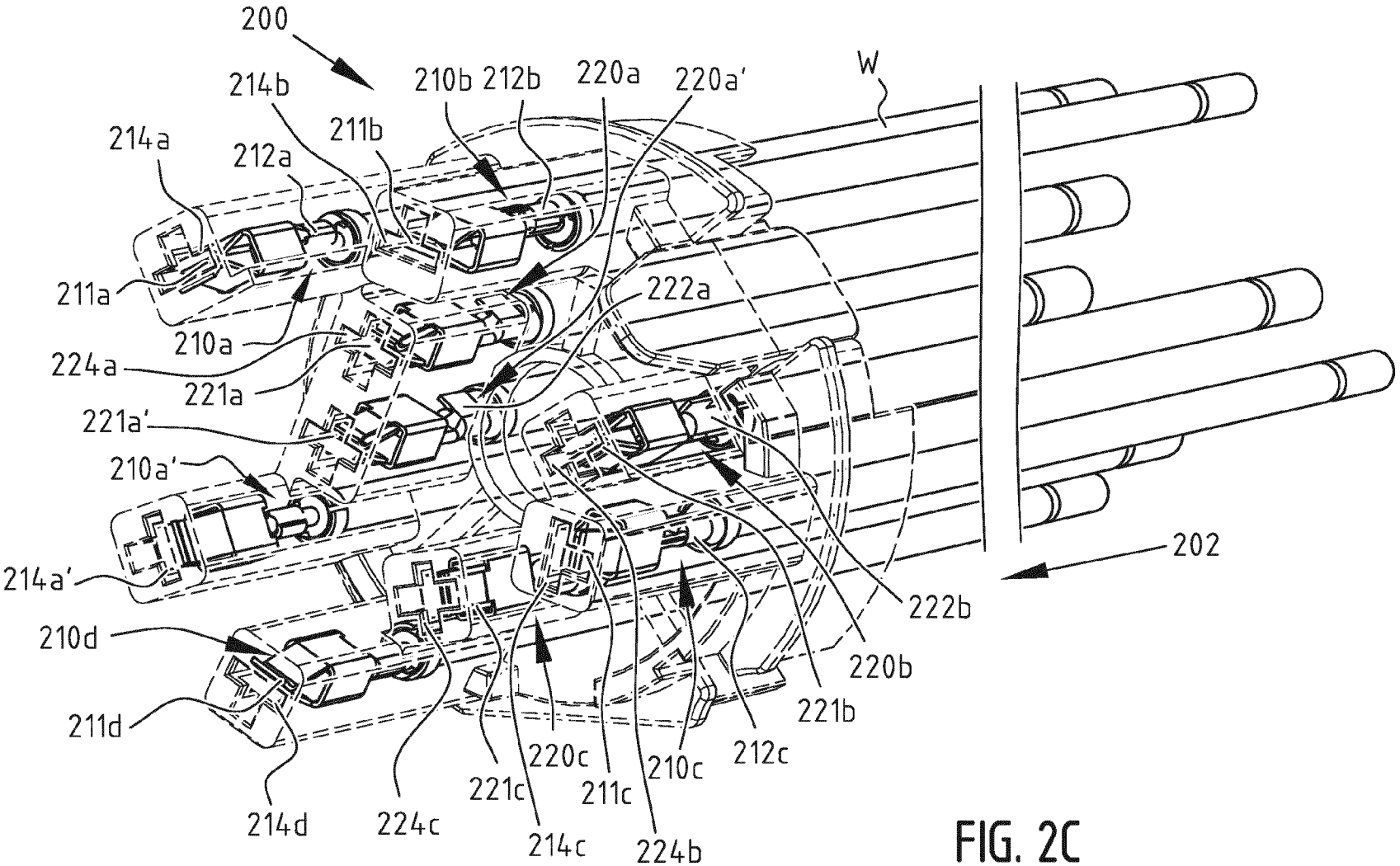
FIG. 2C is a schematic perspective view of the wire connector of FIG. 2A showing the connector contacts inside the wire connector.
Figure 3B:
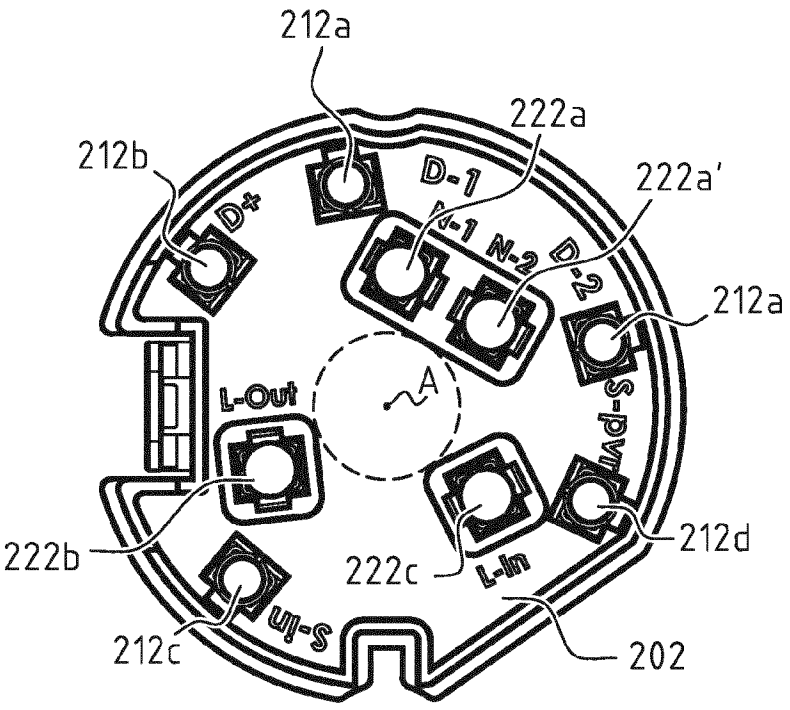
FIG. 3B is a schematic rear view of the wire connector of FIG. 2A.
Figure 3A:
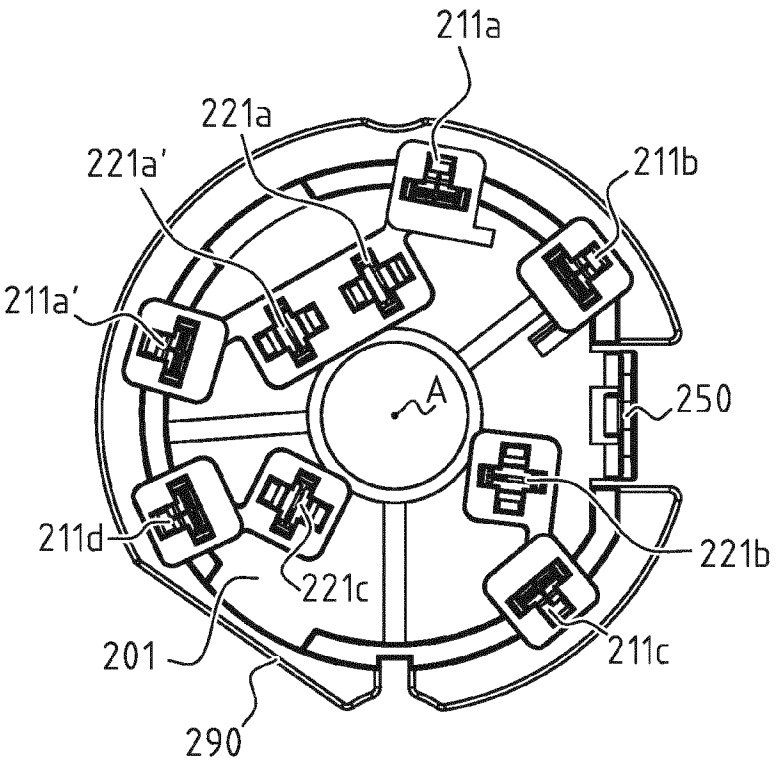
FIG. 3A is a schematic front view of the wire connector of FIG. 2A.

As shown in FIG. 2A, the wire connector 200 is provided at its front side 201 with a plurality of elongate ducts 230*a-d*, 230*a*', 240*a-c* for receiving the plurality of connector contacts 210*a-d*, 210*a*', 220*a-c*, 220*a*'. The plurality of elongate ducts 230*a-d*, 230*a*', 240*a-c* extends in an axial direction (A) of the wire connector 200. As shown in FIG. 4A the receptacle 100 is provide at its rear side 102 with a plurality of channels 130*a-d*, 130*a*', 140*a-c* extending in the direction of the front side 101 and dimensioned for snugly receiving said plurality of ducts 230*a-d*, 230*a*', 240*a-c*. Preferably, the position of the ducts 230*a-d*, 230*a*', 240*a-c* and channels 130*a-d*, 130*a*', 140*a-c* is such that the wire connector 200 can only be plugged in one position in the receptacle 100. The rear contact portions 112*a-d*, 112*a*', 122*a-c*, 122*a*' of the plurality of receptacle contacts 110*a-d*, 120*a-c* are positioned in the channels 130*a-d*, 130*a*', 140*a-c*, and are configured such that they can protrude in the elongate ducts 230*a-d*, 230*a*', 240*a-c* to contact the front contact portions 211*a-d*, 211*a*', 221*a-c*, 221*a*' of the plurality of connector contacts 210*a-d*, 210*a*', 220*a-c*, 220*a*' in the plugged-in state of the wire connector 200. More in particular, a rear contact portion 112*a-d*, 112*a*', 122*a-c*, 122*a*' is shaped like a blade extending in the axial direction which is received between two flexible lips 215, 216 of the front contact portions 211*a-d*, 211*a*', 221*a-c*, 221*a*'. A front end of each duct 230*a-d*, 230*a*', 240*a-c* of the plurality of ducts is provided with an aperture in the form of a slit 214*a-d*, 214*a*', 224*a-c*, 224*a*' configured for receiving a rear contact portion 112*a-d*, 112*a*', 122*a-c*, 122*a*' of a receptacle contact. The apertures in the front ends of the ducts 230*a-d*, 230*a*', 240*a-c* may also be cross-shaped or T-shaped as shown in FIG. 2C in order to be able to insert a tool to remove the wire contact in case of malfunctioning thereof.

The plurality of ducts 230*a-d*, 230*a*', 240*a-c* comprises a first plurality of ducts 230*a-d*, 230*a*' and a second plurality of ducts 240*a-c*. In the plugged-in state, seen in a radial direction around the central axis A of the receptacle 100, the first plurality of ducts 230*a-d*, 230*a*' is positioned further away from the central axis A than the second plurality of ducts 240*a-c* Similarly, the plurality of channels 130*a-d*, 130*a*', 140*a-c* comprises a first plurality of channels 130*a-d* and a second plurality of outwardly protruding ducts 140*a-c*. In the plugged-in state, seen in a radial direction around the central axis A of the receptacle 100, the first plurality of channels 130*a-d*, 130*a*' is positioned further away from the central axis A than the second plurality of channels 140*a-c*.

As can be seen in FIG. 2A, the first plurality of ducts 230*a-d*, 230*a*' may protrude outwardly at the front side 201 of the wire connector 200 over a length L1 which is longer than a length L2 over which the second plurality of ducts 240*a-c* protrudes outwardly. In the illustrated embodiment, as shown in FIG. 2B, the second plurality of ducts 240*a-c* also protrudes outwardly in a rearward direction over a length L2', at the rear side 202 of the wire connector 200. In that manner, the total length of the first and second plurality of ducts 230*a-d*, 240*a-c* can be adapted to receive connector contacts 210*a-d*, 210*a*', 220*a-c*, 220*a*' having substantially the same length. The skilled person understands that also other length distributions are possible: for example, ducts 230*a*, 230*a*', 230*c* and 240*a* could protrude at the front side 201 over a length L1, ducts 230*b*, 230*d*, 240*b*, 240*c* could protrude at the front side 201 over a length L2 different from L1, ducts 230*a*, 230*a*', 230*c* and 240*a* could protrude at the rear side 202 over a length L1', and ducts 230*b*, 230*d*, 240*b*, 240*c* could protrude at the rear side 202 over a length L2' different from L1'. The lengths may be chosen such that L2+L2' and L1+L1' are larger than the length of the plurality of connector contacts.

In a preferred embodiment, one duct 230*d* of the plurality of ducts 230*a-d*, 230*a*', 240*a-c* protrudes more outwardly at the front side 201 than the other ducts of the plurality of ducts. This will allow inserting the wire connector 200 in the receptacle in an easier manner. Indeed, the duct 230*d* can function as a guide which is brought into the corresponding channel 130*d* before the other ducts are brought into corresponding channels.

As is best visible in FIGS. 2A, 4A and 10, the receptacle 100 is provided with a first snap-fit part 150 and the wire connector 200 is provided with a second snap-fit part 250 configured to cooperate with the first snap-fit part 150 in a plugged-in state of the wire connector 200 in the receptacle 100. In the illustrated embodiment the first snap-fit part 150 is a recess formed in the rear side 102 of the receptacle 100, wherein the recess is provided with a first protruding portion 151. The second snap-fit part 250 is formed as a flexible lip with a second protruding portion 251 which snaps behind the first protruding portion 151. Such an embodiment has the advantage that the wire connector 200 can be plugged in the receptacle 100 in a tool-less manner, not requiring any screws. Indeed, the snap-fit parts 150, 250 are configured to ensure a locking action between the wire connector 200 and the receptacle 100.

The receptacle 100 may comprise a substantially cylindrical front portion 181 at the front side 101 of the receptacle 100, and a substantially cylindrical rear portion 182 at the rear side 102 of the receptacle 100. The front portion 181 has larger dimensions than the rear portion 182. The rear portion 182 is intended to be arranged through an opening in a housing of a luminaire, whilst the front portion 181 abuts against a wall of the housing. The substantially cylindrical rear portion 182 may be provided with a screw thread 170 for cooperating with a corresponding screw-thread 370 of the nut 300. As shown in FIG. 1, the nut 300 may be provided with a ribbed surface or a surface with a certain surface roughness, said surface being intended for being in contact with an inner wall of the housing. This will allow to obtain an improved fixation of the receptacle 100 in an opening of the housing H. Although not shown, it is noted that the receptacle 100 may also be fixed to the housing using screws. To that end, the front portion 181 of the receptacle 100 may be provided with a number of through-holes for screws, e.g. two through-holes as shown in FIGS. 1, 5A and 5B. The channels 140*a-c* may extend through the substantially cylindrical front portion 181 and the substantially cylindrical rear portion 182.

Figure 6:
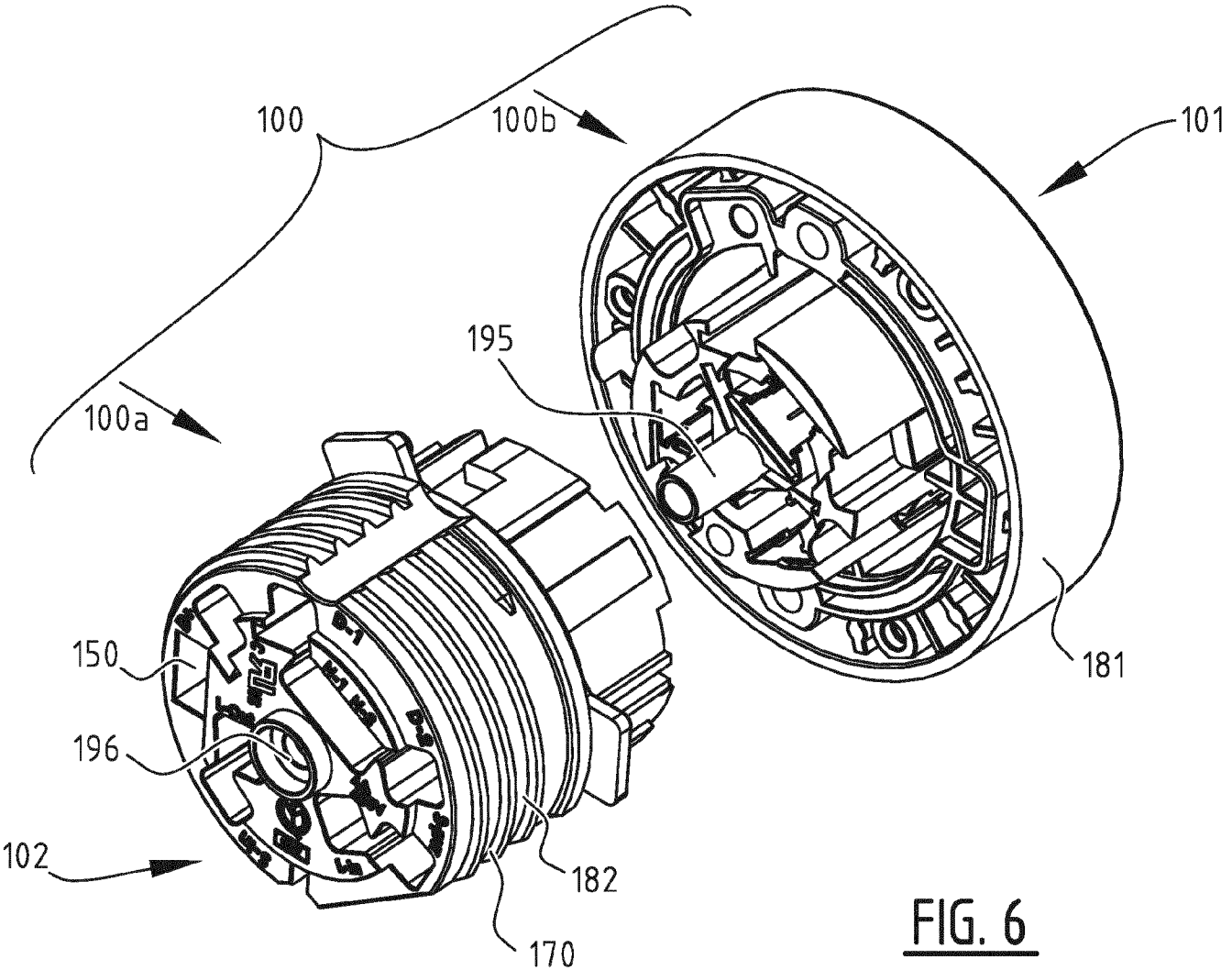
FIG. 6 is a schematic exploded view of the receptacle of FIG. 4A.

The receptacle 100 may be formed in one or in two or more parts. As shown in FIG. 6, the receptacle 100 may comprise a central body portion 100*a* and a flange portion 100*b* which are coupled to each other. To fix the central body portion 100*a* to the flange portion 100*b*, the central body portion 100*a* may be provided with a central hole 196, and the flange portion 100*b* may be provided with a screw receiving portion 195, such that a screw can extend through the central hole 196 into the screw receiving portion 195 to fix the central body portion 100*a* to the flange portion 100*b*.

The substantially cylindrical rear portion 182 may be provided with a flat wall portion 190 extending in an axial direction of the receptacle. The wire connector 200 may have a substantially cylindrical outer wall 282 which is provided with a corresponding flat wall portion 290 intended to be aligned with the flat wall portion 190 of the receptacle 100, in the plugged-in state of the wire connector 200. In that manner the wire connector 200 can be easily aligned with the receptacle 100 when having to plug the wire connector 200 into the receptacle 100. Further the gasket 400 may be provided with a protruding edge portion as shown in FIG. 1 in order to more easily align the gasket on the rear side 102 of the receptacle 100.

Whilst the principles of the invention have been set out above in connection with specific embodiments, it is to be understood that this description is merely made by way of example and not as a limitation of the scope of protection which is determined by the appended claims.

The invention claimed is:

1. A receptacle socket assembly for lighting equipment, said receptacle socket assembly comprising:

a front side being configured for receiving contacts of a control module for controlling the lighting equipment, and a rear side; and a plurality of contacts, a contact of said plurality of contacts being provided, at a front end, with a front contact portion located at said front side and configured for being electrically connected with a contact of a control module; and a contact of said plurality of contacts being provided at a rear end, with a wire receiving contact portion located at said rear side and configured for receiving and fixing a wire end of a wire of the lighting equipment, wherein the plurality of contacts comprises a plurality of first receptacle contacts and one or more second receptacle contacts, said first and second receptacle contacts having front contact portions at said front side, wherein seen in a radial direction around a central axis of the receptacle socket assembly, the plurality of first receptacle contacts is positioned further away from the central axis than the one or more second receptacle contacts.

2. The receptacle socket assembly according to claim 1, wherein, the plurality of first receptacle contacts extends substantially along a first cylindrical surface around the central axis, and the one or more second receptacle contacts extend substantially along a second cylindrical surface around the central axis.

3. The receptacle socket assembly according to claim 1, wherein the front contact portions of the plurality of first receptacle contacts extend flush with the front side of the receptacle.

4. The receptacle socket assembly according to claim 1, wherein a receptacle contact of said plurality of contacts is provided at its rear end with a first rear contact portion and with a second rear contact portion at a distance of said first rear contact portion; and wherein said plurality of contacts comprises a first connector contact having a front contact portion in contact with the first rear contact portion and a second connector contact having a front contact portion in contact with the second rear contact portion.

5. The receptacle socket assembly of claim 1, wherein the plurality of contacts comprises a plurality of first connector contacts and one or more second connector contacts, said first and second connector contacts having wire receiving contact portions at said rear side, wherein, seen in a radial direction around a central axis of the receptacle socket assembly, the plurality of first connector contacts are positioned further away from the central axis than the one or more second connector contacts;

wherein a receptacle contact of said plurality of first receptacle contacts is provided at its rear end with a first rear contact portion and with a second rear contact portion at a distance of said first rear contact portion; and wherein said plurality of first connector contacts comprises a first connector contact having a front contact portion in contact with the first rear contact portion and a second connector contact having a front contact portion in contact with the second rear contact portion;

and wherein a receptacle contact of said one or more second receptacle contacts is provided at its rear end with a first rear contact portion and with a second rear contact portion at a distance of said first rear contact portion; and wherein said one or more second connector contacts comprises a first connector contact having a front contact portion in contact with the first rear contact portion and a second connector contact having a front contact portion in contact with the second rear contact portion.

6. The receptacle socket assembly according to claim 1, wherein the front contact portions of the plurality of contacts extend at or near the front side.

7. The receptacle socket assembly according to claim 1, wherein the wire receiving contact portion comprises a first portion for clamping a wire end and a second portion for clamping a cable sheath end surrounding the wire.

8. The receptacle socket assembly according to claim 1, wherein the receptacle socket assembly comprises an RFID tag, preferably at the front side of the receptacle socket assembly.

9. The receptacle socket assembly according to claim 1, wherein the plurality of contacts comprises:

at least two contacts for carrying power signals, preferably at least three receptacle contacts for carrying power signals, and/or one or more contacts for carrying data or control signals, preferably at least two receptacle contacts for carrying data or control signals, and/or one or more contacts for carrying power signals and data or control signals.

10. A luminaire comprising a housing with an opening and a receptacle socket assembly according to claim 1, wherein the receptacle socket assembly is arranged in the opening of the housing with its rear side facing an inner space of the housing, and wherein the receptacle socket assembly is connected to components inside the housing.

11. The receptacle socket assembly according to claim 1, wherein the plurality of contacts comprises a plurality of first connector contacts and one or more second connector contacts, said first and second connector contacts having wire receiving contact portions at said rear side, wherein, seen in a radial direction around a central axis of the receptacle socket assembly, the plurality of first connector contacts are positioned further away from the central axis than the one or more second connector contacts.

12. The receptacle socket assembly according to claim 11, wherein the plurality of first connector contacts extends substantially along a first cylindrical surface around the central axis, and the one or more second connector contacts extend substantially along a second cylindrical surface around the central axis.

13. A receptacle socket assembly for lighting equipment, said receptacle socket assembly comprising:

a front side being configured for receiving contacts of a control module for controlling the lighting equipment, and a rear side; and a plurality of contacts, a contact of said plurality of contacts being provided, at a front end, with a front contact portion located at said front side and configured for being electrically connected with a contact of a control module; and a contact of said plurality of contacts being provided at a rear end, with a wire receiving contact portion located at said rear side and configured for receiving and fixing a wire end of a wire of the lighting equipment, wherein the receptacle socket assembly is provided at the rear side thereof with a screw-thread, and wherein the receptacle socket assembly further comprises a nut configured to be screwed on the screw-thread of the receptacle socket assembly.

14. The receptacle socket assembly according claim 13, further comprising a gasket inserted between the nut and the front portion.

15. A receptacle socket assembly for lighting equipment, said receptacle socket assembly comprising:

a front side being configured for receiving contacts of a control module for controlling the lighting equipment, and a rear side; and a plurality of contacts, a contact of said plurality of contacts being provided, at a front end, with a front contact portion located at said front side and configured for being electrically connected with a contact of a control module; and a contact of said plurality of contacts being provided at a rear end, with a wire receiving contact portion located at said rear side and configured for receiving and fixing a wire end of a wire of the lighting equipment, wherein the receptacle socket assembly comprises a substantially cylindrical front portion at the front side, and a substantially cylindrical rear portion at the rear side, wherein the diameter of the front portion is larger than the diameter of the rear portion.

16. The receptacle socket assembly according to claim 15, wherein the substantially cylindrical rear portion is provided with a flat wall portion extending in an axial direction of the receptacle socket assembly.

* * * * *